US007166802B2

(12) United States Patent
Cusson et al.

(10) Patent No.: US 7,166,802 B2
(45) Date of Patent: Jan. 23, 2007

(54) ELECTRICAL POWER CABLE HAVING EXPANDED POLYMERIC LAYERS

(75) Inventors: Daniel Cusson, Saint-Bruno-de Montarville (CA); Paul Cinquemani, Lexington, SC (US); Paolo Veggetti, Monza (IT); Marco Frigerio, Dolzago (IT); Alberto Bareggi, Milan (IT)

(73) Assignee: Prysmian Cavi E Sistemi Energia S.r.L., Milan (IT)

( * ) Notice: Subject to any disclaimer, the term of this patent is extended or adjusted under 35 U.S.C. 154(b) by 0 days.

(21) Appl. No.: 11/020,196

(22) Filed: Dec. 27, 2004

(65) Prior Publication Data

US 2006/0137894 A1 Jun. 29, 2006

(51) Int. Cl.
*H01B 11/02* (2006.01)

(52) U.S. Cl. ..... 174/113 R; 174/105 R

(58) Field of Classification Search ..... 174/113 R, 174/116, 120 R, 110 F, 105 R
See application file for complete search history.

(56) References Cited

U.S. PATENT DOCUMENTS

| | | | | |
|---|---|---|---|---|
| 2,621,703 | A | 12/1952 | Morrison | |
| 4,398,058 | A | 8/1983 | Gerth et al. | |
| 5,015,800 | A | 5/1991 | Vaupotic et al. | |
| 6,486,395 | B1 * | 11/2002 | Temblador | 174/36 |
| 6,501,027 | B1 | 12/2002 | Belli et al. | |
| 2003/0079903 | A1 | 5/2003 | Scheidecker et al. | |
| 2003/0141097 | A1 | 7/2003 | Belli et al. | |
| 2004/0262027 | A1 * | 12/2004 | Kaczmarski | 174/113 R |

FOREIGN PATENT DOCUMENTS

| | | |
|---|---|---|
| JP | 09-035544 | 2/1997 |
| WO | WO 02/45100 A1 | 6/2002 |

OTHER PUBLICATIONS

European Search Report for U.S. 2,019,604.
International Search Report and the Written Opinion of the International Searching Authority for PCT/US2005/047161.

* cited by examiner

*Primary Examiner*—Chau N. Nguyen
(74) *Attorney, Agent, or Firm*—Finnegan, Henderson, Farabow, Garrett & Dunner, L.L.P.

(57) ABSTRACT

A cable comprises at least two cores stranded together, an expanded inner jacket layer, a substantially circular metallic armor partially contacting the inner jacket to form unfilled interstices outside the inner jacket, and a polymeric outer jacket. The expanded inner jacket substantially takes the shape of the periphery of the stranded cores, providing a non-circular cross section for the expanded inner jacket. A method of producing a cable comprises providing at least two cores, expanding a polymeric material, extruding the expanded polymeric material around the cores, and allowing the expanded polymeric material to collapse onto the cores. A substantially circular metallic armor is applied, resulting in a plurality of unfilled voids between the inner jacket and the metallic armor. An outer jacket is extruded on the metallic armor.

16 Claims, 7 Drawing Sheets

PRIOR ART

PRIOR ART

ELECTRICAL POWER CABLE HAVING EXPANDED POLYMERIC LAYERS

TECHNICAL FIELD

This invention relates generally to electrical power cables having decreased weight and material costs. More specifically, it relates to low and medium voltage multipolar cables having expanded materials in one or more jacket layers.

BACKGROUND

An effective electrical power cable needs to satisfy several competing structural needs. On one hand, a power cable should be lightweight, easy to handle, and inexpensive to produce. On the other hand, a cable should be solidly built, exhibit good fire retardancy properties (if required), and be rigid enough to withstand the rigors of the elements and the stresses placed on it during installation. Maximizing any one of these characteristics, however, often has a detrimental impact on at least one of the others. Moreover, nonfunctional features such as the surface finish of the completed cable often play a factor in the acceptance level of a power cable. Consequently, existing power cables, such as the cable depicted in FIGS. 1 and 2, typically strike a compromise between these needs.

FIG. 1 is a transverse cross-sectional view of an exemplary conventional cable. The cable contains three "cores," with each core being a semi-finite structure comprising a conductive element 105 and at least one layer of electrical insulation 120 placed in a position radially external to the conductive element 105. When considering a cable for medium voltage electrical power, the core may also comprise an internal semiconductive covering 115 located in a position radially external to the conductive element, an external semiconductive covering located in a position radially external to the layer of electrical insulation 125, and a metal screen in a position radially external to the external semiconductive covering (not shown).

For the purposes of the present description, the term "multipolar cable" means a cable provided with at least a pair of cores as defined above. In greater detail, if the multipolar cable has a number of cores equal to two, the cable is technically termed a "bipolar cable," and if the cores number three the cable is known as a "tripolar cable." The conventional cable of FIG. 1 is a tripolar cable.

The cores, along with ground wires 110, are joined together to form a so-called "assembled element." Preferably, the joining is accomplished by helicoidally winding the cores and ground wires together at a predetermined pitch. As a result of the joining and winding of the cores, the assembled element has a plurality of interstitial zones 130, which are defined by the spaces between the cores and ground wires. In other words, the joining and winding of the cores and their circular shape gives rise to a plurality of voids between them.

The production process for a conventional multipolar cable comprises the step of filling the interstitial zones 130 to confer a circular shape to the assembled element. The interstitial zones, which are also known as "star areas," are generally filled with a filler of the conventional type (e.g., a polymeric material applied by extrusion). The resulting circular shape provides a solid body with a symmetrical appearance and feel.

The cable is finished by applying at least one other layer, the nature of which, as well as the number of layers, depend on the type of multipolar cable to be obtained. In the conventional cable of FIG. 1, a layer of binder tape 135 may be provided in a position radially external to the assembled element, and a polymeric inner jacket layer 140 is provided in a position radially external to the binder tape. This inner jacket layer 140 is typically made from a polymeric material and is extruded over the binder tape. Given the circular cross-section of the assembled element, inner jacket layer 140 assumes the shape of the binder material or filling material, i.e., the inner jacket also becomes circular in cross-section. Finally, a metallic armor 145 is provided in a position radially external to the inner jacket layer 140, and the entire cable is clad in a polymeric outer jacket 150.

FIG. 2 is a longitudinal perspective view of the conventional cable of FIG. 1. The same numbering has been used as in FIG. 1 to show the correlation between the drawings. FIG. 2 illustrates the concentricity provided by the filling material 130 in the voids around and between the conductive elements 105.

This type of conventional cable has historically been employed in industrial and commercial power cable applications (e.g., installation in cable trays, troughs, and ladders) as a replacement for cable enclosed in metal conduit and certain classifications of hazardous locations as defined by local codes and authorities. For combustible hazardous environments, the outer jacket of the cable often comprises fire retardant polymers. These cables comply with nationally regulated flame retardancy tests, such as defined in the standards IEEE-1202 ("Standard for IEEE Standard for Flame Testing of Cables for Use in Cable Tray in Industrial and Commercial Occupancies"), UL-1685 ("Standard for Vertical Tray Fire Propagation and Smoke Release Test for Electrical and Optical Fiber Cables"), CSA Std. C22.2 FT-4 (vertical flame test), and IEC 332-3 (vertical-tray, high-energy combustion propagation test) specifications. For example, to satisfy the requirements of CSA Std. C22.2 FT-4, the cable is subjected to a burner mounted 20° from the horizontal with the burner facing up. To pass the test, the cable may only char within 1.5 m of the burner. The other standards require subjecting the cable to similar fire retardancy tests.

For a number of reasons (e.g., weight reduction), expanded polymeric materials have been used for the conventional filler and jacketing materials. Expanded polymeric materials are polymers that have a reduced density because gas has been introduced to the polymer while in a plasticized or molten state. This gas, which can be introduced chemically or physically, produces bubbles within the material, resulting in voids. A material containing these voids generally exhibits such desirable properties as reduced weight and the ability to provide more uniform cushioning than a material without the voids. The addition of a large amount of gas results in a much lighter material, but the addition of too much gas can negatively impact the surface finish of the polymer and decrease some of the resiliency of the material.

The expanded material is typically extruded to form its desired shape. After the material leaves the extrusion die, it stretches and cools. The degree of stretching is defined by the drawdown ratio. More specifically, the drawdown ratio is calculated as the ratio of the cross-sectional area of the material as it leaves the extrusion die to the material's cross-sectional area after cooling. Applicants have recognized that controlling the drawdown ratio can help achieve a relatively high degree of expansion while also maintaining required resiliency and achieving a smooth surface finish.

Several publications describe power cables that include expanded materials. For example, WO 02/45100 A1 discloses a modified conventional cable using an expanded material as a filler between the interstitial areas created in the assembled element. The use of expanded material as a filler results in a cable that is lighter than the conventional cable and provides improved impact resistance. But due to the somewhat unpredictable expansion of the filler disclosed in that publication, a containment layer is required to achieve a substantially circular cable. This layer requires further processing, adding to the overall cost of the cable.

U.S. Patent Application Publication 2003/0079903 A1 discloses a cable wherein both the outer jacket and the filled interstitial zones may contain expanded material. This cable is allegedly lighter than the cable of WO 02/45100 A1. U.S. Pat. No. 6,501,027 B1 and U.S. Patent Application Publication 2003/0141097 A1 disclose multipolar cables with a layer of expanded polymeric material in the outer jacket.

Although these documents address the use of expanded materials particularly in the outer jackets of electrical power cables, Applicants have noted that the interior structure of the cable provides opportunities to decrease cable weight while maintaining the required structural characteristics. Furthermore, Applicants have recognized that when a metal protection is used in the cable structure such as a metallic armor, in particular in multipolar cable designs, the use of an expanded material layer inside the metal protection provides additional protection. For example, in case an impact causes a permanent deformation of the metal protection, an inner expanded layer may protect what might otherwise result in a compression of the insulation of one or more of the cores enclosed within the metal protection, thereby resulting in a reduced electrical stress resistance capability when the cable is under load. In addition, Applicants have recognized that balancing the expansion degree and drawdown ratio of the manufacturing process for expanded materials can lead to lighter power cables with satisfactory impact resistance and cosmetic finish.

SUMMARY

In accordance with the principles of the invention, a cable comprises at least two cores, and the cores are stranded together to form an assembled element. An inner jacket layer comprising an expanded polymeric material surrounds and substantially takes the shape of the periphery of the assembled element. A cross-section of the inner jacket layer and assembled element is non-circular. The cable also comprises a metallic armor having a substantially circular cross-section that surrounds and partially contacts the inner jacket layer. The cable further comprises a polymeric jacket that surrounds the metallic armor and forms the exterior of the cable.

Typically, the portion of the inner jacket layer located in a position bridging two stranded cores is concave in a direction toward the axis of the cable. This construction results in inner interstices between the stranded cores on the axial side of the inner jacket layer, and outer interstices between the inner jacket layer and the metallic armor. The outer interstices are typically devoid of filler material. Preferably, the polymeric material of the inner jacket has a degree of expansion of about 2% to about 50%, although higher degrees of expansion may be obtained, and has been formed by extrusion with a drawdown ratio preferably of about 1.1:1 to about 2.4:1, more preferably of about 1.4:1 to about 1.9:1.

Also in accordance with the principles of the invention, a method of making an electrical cable comprises providing at least two cores to form an assembled element. The method further comprises expanding a polymeric material with a foaming agent, preferably of exothermic type, and extruding the expanded polymeric material in a layer around the assembled element using a pre-determined drawdown ratio, preferably of about 1.1:1 to about 2.4:1, more preferably of about 1.4:1 to about 1.9:1, and collapsing onto the assembled element. A metallic armor is applied around the expanded polymeric material, the armor being substantially circular and creating a plurality of voids between the armor and the expanded polymeric material. The method further comprises extruding an outer jacket on the metallic armor.

Typically, the polymeric material is expanded in the range of about 2% to about 50%. The method may also comprise foaming the outer jacket material before extruding the outer jacket on the metallic armor.

It is to be understood that both the foregoing general description and the following detailed description are exemplary and explanatory only, and are not restrictive of the invention as claimed.

BRIEF DESCRIPTION OF THE DRAWINGS

The accompanying drawings, which are incorporated in and constitute a part of this specification, illustrate several embodiments of the invention, and together with the description, serve to explain the principles of the invention.

DETAILED DESCRIPTION

Reference will now be made in detail to embodiments consistent with the principles of the invention, examples of which are illustrated in the accompanying drawings. Wherever possible, the same reference numbers will be used throughout the drawings to refer to the same or like parts.

A cable consistent with the principles of the invention comprises multiple cores, the stranding of which results in several interstitial voids between the cores. The cable is assembled without filling the interstitial voids, or if filler is used, the filler does not provide the assembled element with a substantially circular cross-section. An inner polymeric jacket comprising an expanded material surrounds the assembled element and substantially takes the shape of the periphery of the stranded cores. Hence, the inner jacket possesses a non-circular shape. A substantially circular metallic armor is applied around the inner jacket to form a mechanically rigid structure. This metallic armor partially contacts the non-circular inner jacket to form a second set of interstitial voids. These voids are left unfilled. Finally, a polymeric outer jacket is applied over the metallic armor.

Figure 1:
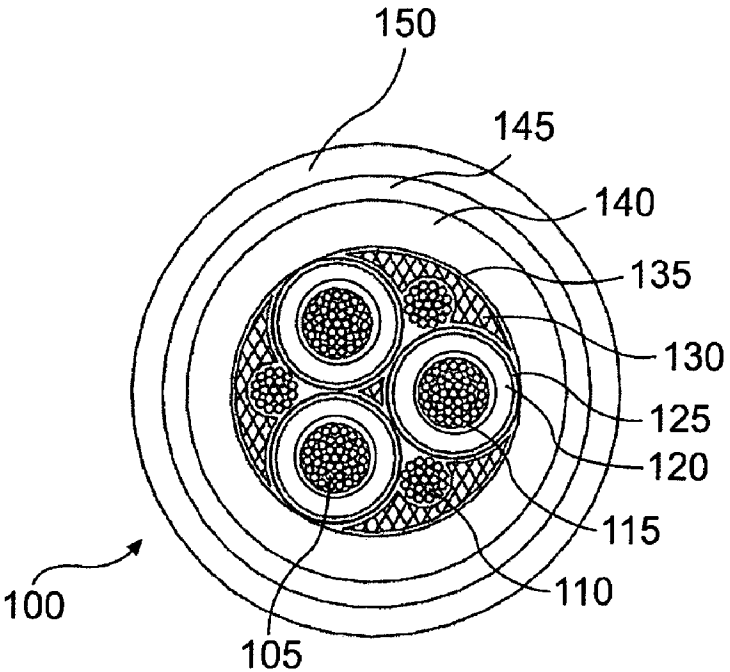
FIG. 1 is a transverse cross-sectional diagram of a conventional tripolar cable.
Figure 2:
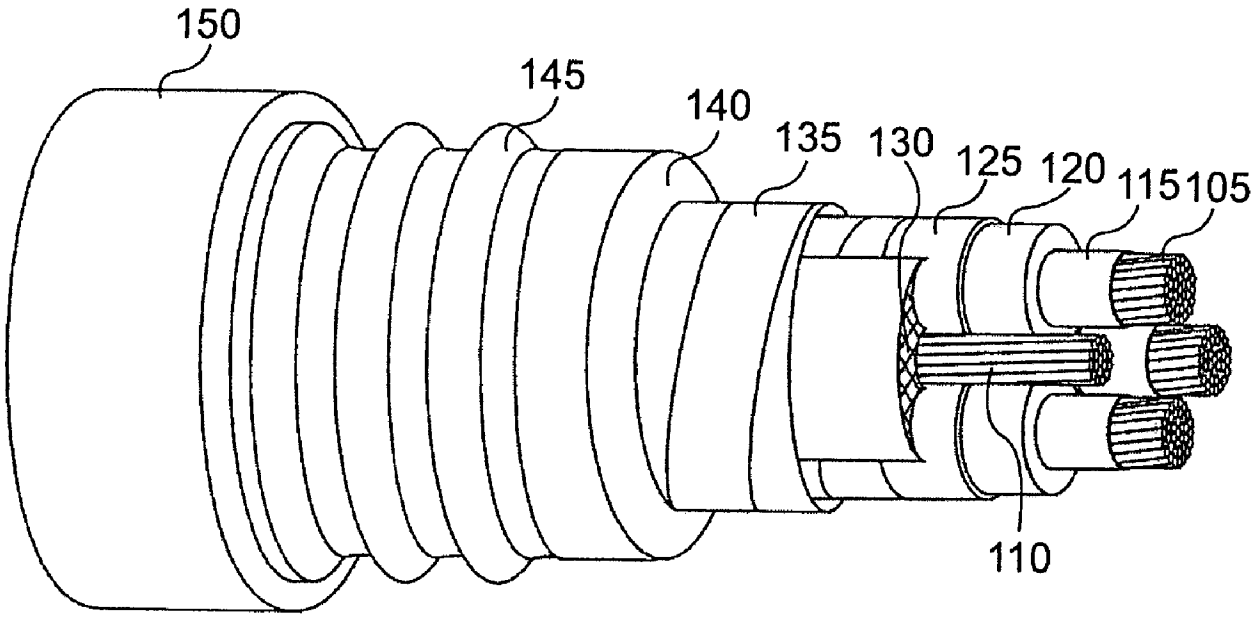
FIG. 2 is a longitudinal perspective diagram of the conventional tripolar cable of FIG. 1.
Figure 3A:
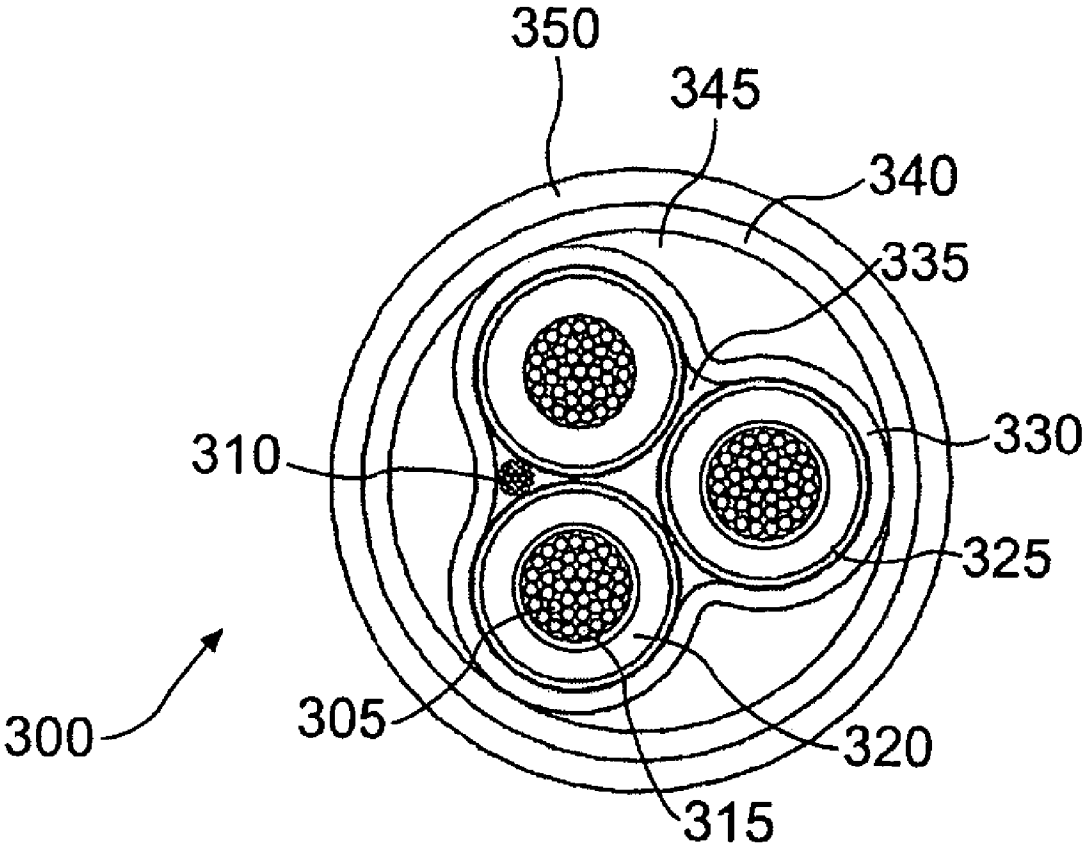
FIG. 3A is a transverse cross-sectional diagram of a tripolar cable consistent with the principles of the invention.

FIG. 3A is a transverse cross-sectional diagram of a tripolar cable of the type just described. The cable 300 includes three cores having a conducting element 305, a semiconducting conductor shield 315 disposed in a radially external position to the conductor 305, an insulation layer 320 disposed in a radially external position to the semiconducting conductor shield 315, and a semiconducting insulator shield 325 disposed in a radially external position to the insulation layer 320.

An inner polymeric jacket 330 that has been expanded is extruded over the multiple cores. Jacket 330 binds the conductors and provide for an improved cushioning layer. Without fillers, the expanded layer 330 substantially takes the shape of the underlying stranded cores. Interstices or voids may remain axially inside of inner jacket layer 330 between the cores.

Outside inner jacket layer 330, a metallic armor 340 and an outer jacket 350 encircle the cable. Both layers attain substantially circular cross-sections, leaving voids between the inner jacket layer 330 and the metallic armor 340.

Turning back to the assembled element, the conducting element 305, ground wire 310, semiconducting conductor shield 315, insulation layer 320, and semiconducting insulation shield 325 may be selected from materials known to those of ordinary skill in the art. For example, one of ordinary skill in the art would recognize that the insulation layer 320 may comprise a cross-linked or non-cross-linked polymeric composition with electrical insulating properties known in the art. Examples of such insulation compositions for low and medium voltage cables are: crosslinked polyethylene, ethylene propylene rubber, polyvinyl chloride, polyethylene, ethylene copolymers, ethylene vinyl acetates, synthetic and natural rubbers.

One of ordinary skill would also recognize that the conducting element 305 may comprise mixed power/telecommunications cables, which include an optical fiber core in addition to or in place of electrical cables. Therefore, the term "conductive element" means a conductor of the metal type or of the mixed electrical/optical type.

The cores and ground wire 310 are stranded together in a conventional manner. In this instance, they are wound together helicoidally to form an assembled element. The helicoidal winding of the conductors gives rise to formation of several interstitial zones 335, referred to here as inner interstices, which may optionally be filled with expanded or non-expanded material. If fillers are employed in the inner interstices 335, they are present primarily to meet regulatory standards, not to provide a substantially circular cross-section for the assembled element as in a conventional cable. When fillers are employed in the inner interstices 335, they are then referred to as the "filler layer."

Figure 3C:
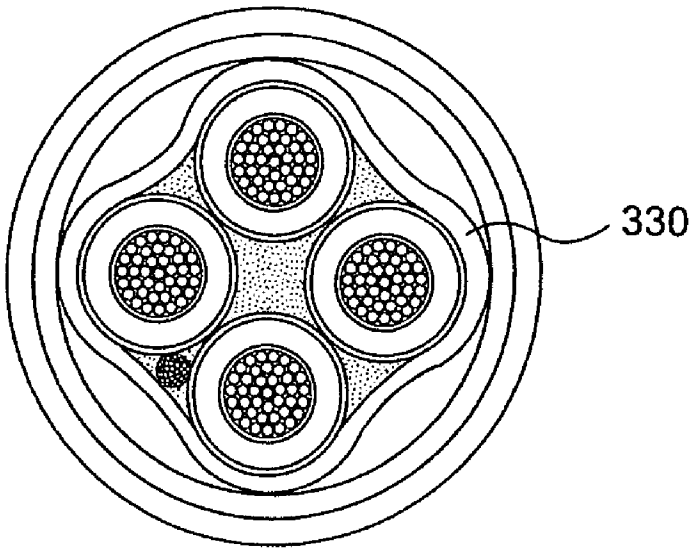
FIG. 3C is a transverse cross-sectional diagram of a quadpolar cable consistent with the principles of the invention.
Figure 3B:
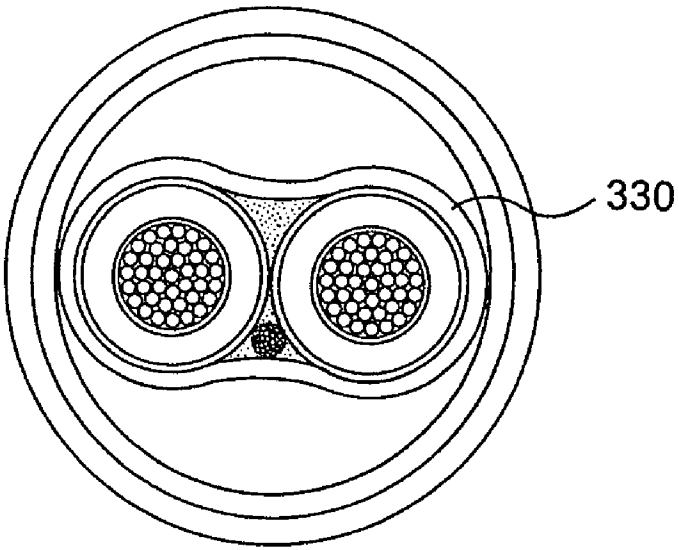
FIG. 3B is a transverse cross-sectional diagram of a bipolar cable consistent with the principles of the invention.

An inner jacket layer 330 is disposed in a radially external position to the assembled element. As illustrated in FIGS. 3A–3C, this inner jacket layer 330 substantially takes the shape of the periphery of the stranded cores. It comprises an expanded polymeric material, which is produced by expanding (also known as foaming) a known polymeric material to achieve a desired density reduction. The expanded polymeric material of the inner jacket layer can be selected from the group comprising: polyolefins, copolymers of different olefins, unsaturated olefin/ester copolymers, polyesters, polycarbonates, polysulphones, phenolic resins, ureic resins, and mixtures thereof. Examples of preferred polymers are: polyvinyl chlorides (PVC), ethylene vinyl acetates (EVA), polyethylene (categorized as low density, linear low density, medium density and high density), polypropylene, and chlorinated polyethylenes.

The selected polymer is usually expanded during the extrusion phase. This expansion may either take place chemically, by means of addition of a suitable foaming masterbatch (i.e., one which is capable of generating a gas under defined temperature and pressure conditions), or may take place physically (i.e., by means of injection of gas at high pressure directly into the extrusion cylinder). Examples of suitable chemical expanders are azodicarbonamide, mixtures of organic acids (for example citric acid) with carbonates and/or bicarbonates (for example sodium bicarbonate). Examples of gases to be injected at high pressure into the extrusion cylinder are nitrogen, carbon dioxide, air and low-boiling hydrocarbons such as propane and butane.

The expanded polymeric material contains a predetermined percentage of voids within the material. The voids are spaces that are not occupied by polymeric material, but by gas or air. In general, the percentage of voids in an expanded polymer is expressed by the so-called "degree of expansion" (G), defined as follows:

$$G=(d_0/d_e-1)\times 100$$

where $d_0$ indicates the density of the unexpanded polymer and $d_e$ represents the measured apparent density of the expanded polymer. It is desirable to obtain as great a degree of expansion as possible while still achieving the desired cable properties. A higher degree of expansion will result in reduced material costs and may improve the impact resistance of the cable. Applicants have found that suitable degrees of expansion are generally in the range of about 2% to about 50%, although higher degrees of expansion may be obtained.

Because a containment layer is not employed for an expandable polymeric jacket, one must use a foaming technology that provides a reliable degree of expansion. The selected foaming technology should be capable of achieving consistent cable dimensions and uniform surface conditions of the polymeric jacket. Several elements are known to affect foaming consistency. They are: 1) the addition rate of the foaming masterbatch; 2) the type of foamed cell structure achieved within the polymeric wall; 3) the extrusion speed; and 4) the cooling trough water temperature after extrusion. Those of ordinary skill in the art can determine the parameters for achieving the desired result.

Figure 5A:
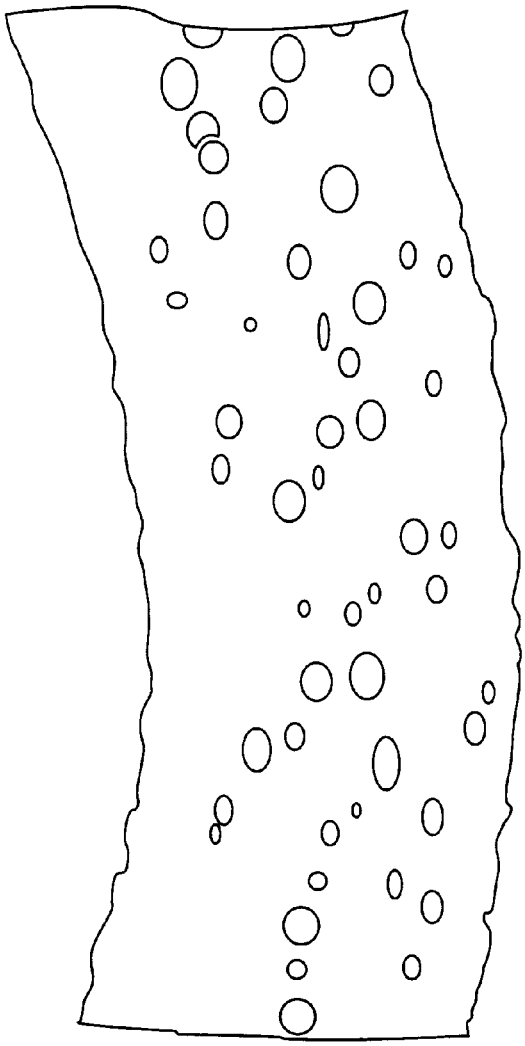
FIGS. 5A and 5B depict expanded polymeric materials under magnification.
Figure 5B:
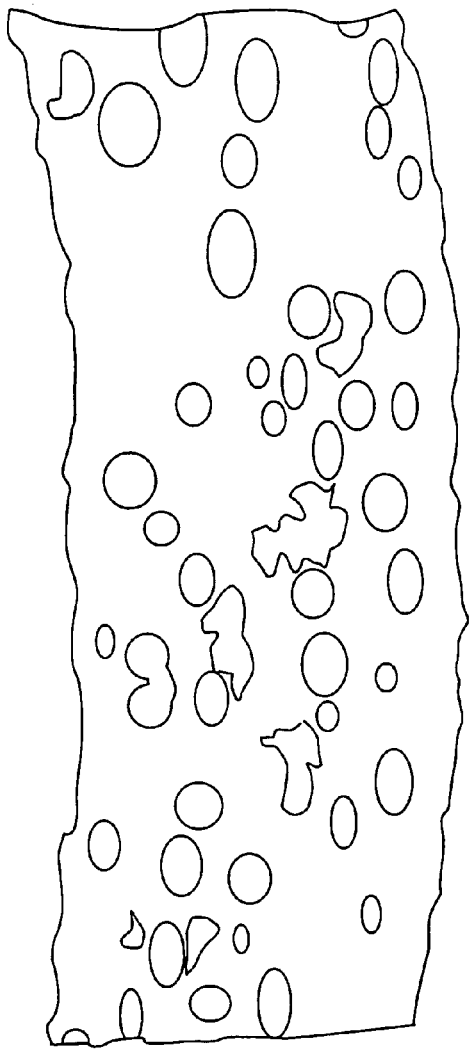

In a preferred embodiment, a closed-cell foaming structure is used because it tends to provide an increase in the number of voids with greater uniformity in the size of the voids. Applicants have found that the use of such foaming agents has improved foaming consistency, diameter control, and the resulting surface finish of the outer skin of the polymeric jacket. FIGS. 5A and 5B illustrate the potential inconsistency that results if the foaming process does not obtain a closed-cell foaming structure. The expanded jacket of FIG. 5A contains relatively uniform, closed cells, providing a smooth jacket surface. In contrast, the expanded jacket of FIG. 5B contains non-uniform, large, and broken cells resulting in poor diameter control and a rough external jacket surface.

Another aspect of obtaining good diameter control is the use of a diluted phase foaming agent due to the low levels foaming agent employed. Dilution of the foaming agent aids in achieving proper dispersion and uniform foaming, particularly when a containment layer is not utilized. A preferred foaming agent is an azodicarbonamide-based material known as "HOSTATRON SYSTEM PV 22167" masterbatch, which is an exothermic foaming agent marketed by Clariant (Winchester, Va.). Other foaming agents found to provide acceptable results are Clariant "HOSTATRON PVA0050243ZN" and Clariant "HOSTATRON PVA0050267/15."

The choice of whether to use an endothermic, exothermic, or hybrid chemical foaming agent will depend on the selection of the base material for the jacketing compound and compatibility therewith, extrusion profiles and processes, the desired amount of foaming, cell size and structure, as well as other design considerations particular to the cable being produced. In general, given similar amounts of active ingredient, exothermic chemical foaming agents will reduce density the most and produce a foam with more uniform and larger cells. Endothermic foaming agents produce foams with a finer cell structure. This is a result, at least in part, of the endothermic foaming agent releasing less gas and having a better nucleation controlled rate of gas releases than an exothermic foaming agent. While an exothermic foaming layer is employed in a preferred embodiment, other foaming agents can result in satisfactory cell structures. A closed-cell structure is preferred so as to not provide channels for water migration, and to provide good mechanical strength and a uniform surface texture of the expanded jacket.

Applicants have observed that the drawdown ratio ("DDR") achieved during sleeving extrusion impacts the surface quality of the expanded jacket. The drawdown ratio is defined by the following equation:

$$DDR = \frac{D_2^2 - D_1^2}{d_2^2 - d_1^2}$$

wherein $D_2$ is the die orifice diameter, $D_1$ is the outer diameter of the guiding tip, $d_2$ is the outer diameter of the cable jacket, and $d_1$ is the inner diameter of the cable jacket.

The appropriate drawdown ratio for achieving a desired surface finish may be determined experimentally, and will vary based on the polymer used, the nature of the foaming agent, and the amount of the foaming agent. Using PVC JC-513-GO and HOSTATRON SYSTEM PV 22167 as an example combination, Table 1 illustrates the impact the drawdown ratio has on the surface quality of the semi-finished cable. Except as noted in the table, all production conditions (e.g., line speed or feed rate) were kept consent.

TABLE 1

| Sample | Hostatron (%) | Overall Diameter (mm) | DDR | Density (g/cm$^3$) | Density Reduction (%) | Surface Quality |
|---|---|---|---|---|---|---|
| 1 | 0 | 4.1 | 1.6 | 1.393 | 0.0 | Smooth |
| 2 | 0 | 3.5 | 2.2 | 1.393 | 0.0 | Smooth |
| 3 | 0.8 | 4.1 | 1.6 | 0.953 | 31.6 | Not as smooth, but still acceptable |
| 4 | 0.8 | 3.85 | 1.8 | 0.860 | 38.3 | Rough |
| 5 | 0.8 | 3.7 | 2.0 | 0.899 | 35.5 | Very rough |
| 6 | 0.8 | 3.6 | 2.1 | 0.978 | 29.8 | Very rough |
| 7 | 0.5 | 4.2 | 1.5 | 1.301 | 6.6 | Smooth |
| 8 | 0.5 | 3.8 | 1.9 | 1.220 | 12.4 | Smooth |
| 9 | 0.5 | 3.6 | 2.1 | 1.202 | 13.7 | Not as smooth, but still acceptable |

As will be appreciated, an acceptable surface finish depends on the intended application for the cable. Moreover, the acceptability of the surface finish is typically determined by one of ordinary skill in the art, often by touch or visual inspection. Although techniques exist for measuring the surface smoothness of materials and may be employed to gauge the smoothness of an expanded jacket according to the present invention, those techniques generally are employed for materials where smoothness is so critical that it cannot be determined by visual observation or by touch.

As the table illustrates, an acceptable surface finish for an inner jacket in an electrical power cable made using PVC JC-513-GO and HOSTATRON SYSTEM PV 22167 can be obtained with a drawdown ratio of about 1.5:1 to about 1.9:1. The ratio of about 1.6:1 to about 1.8:1 is preferred because an acceptable jacket surface can be obtained while achieving a relatively high density reduction. For example, sample 3 has a density reduction of 31.6% with a DDR of 1.6:1, while still achieving an acceptable cosmetic finish. The high density reduction of sample 3 results in a lighter cable than, for example, sample 7, which has a density reduction of 6.6%.

Because the inner jacket layer 330 takes the shape of the stranded cores, as shown in FIGS. 3A–3C, the assembled element takes on an irregular shape. In the tripolar exemplary cable of FIG. 3A, the inner jacket takes a shape resembling a triangle. In a cable with four conductors, as in FIG. 3C, the inner jacket takes a shape resembling a diamond. For cable designs above four conductors, the final conformation will vary and is dependent on the actual number of conductors. This inner jacket layer provides an improved cushioning layer between the cores and the outer layers of the cable. The expanded inner jacket layer provides for more uniform cushioning than conventional jacketing, particularly at high mechanical stress points.

A substantially circular metallic armor 340 is provided in a position radially external to the inner jacket layer 330. The metallic armor 340 is normally in the form of helically applied metal tapes shaped with interlocked grooves. It is applied over the assembled element to form a mechanically rugged structure. The metallic armor 340 contacts the inner jacket layer at the same number of points as there are cores in the cable. Thus, as illustrated, in a tripolar cable, the metallic armor 340 contacts the inner jacket 330 at three points. In a four-core configuration, the metallic armor contacts the inner jacket layer at four points. The metallic armor preferably comprises aluminum, but other suitable materials are known to those of ordinary skill in the art, such as steel.

The respective shapes of the inner jacket layer 330 and the metallic armor 340 give rise to interstitial voids 345, referred to here as outer interstices. These outer interstices are left unfilled, providing a cable that is lighter than a similar cable whose interstitial voids are filled with a filler. Because the cable is lighter than similar cables, it is easier to transport, and consequently results in reduced transportation costs. It is also easier to handle during installation, and generally requires a lower pulling force to be applied during installation. Thus, the cable may result in lower installation costs and greater simplicity in installation operations.

The presence of the expanded jacket layer 330 between the cores and the metallic armor 340, thanks to the relatively high deformability of such expanded jacket layer 330, also contributes to increase the impact resistance of the cable, in that the deformation caused by an impact on the metallic armor 340 is not directly transmitted to the insulation 320 of the cores. This has the benefit that, for example, a permanent deformation of the metallic armor 340 would be largely absorbed in the expanded jacket layer 330 thickness, without being transferred to the insulation of one of the cores, whose thickness is therefore not diminished. As the safe cable operation is directly associated with the insulation thickness of the cores, the cable reliability is further improved also in the presence of the metallic armor surrounding the cores.

An outer jacket 350 is disposed in a position radially external to the metallic armor 340. The outer jacket 350, in conjunction with the metallic armor 340, serves to provide the cable with mechanical strength against accidental impacts. If the outer jacket comprises a non-expanded material, it may be selected, for example, from the group comprising: low density polyethylene (LDPE) (density=0.910–0.926 g/cm$^3$); ethylene copolymers with α-olefins; polypropylene (PP); ethylene α-olefin rubbers, in particular ethylene/propylene rubbers (EPR), ethylene/propylene/diene rubbers (EPDM); natural rubber; butyl rubbers, and mixtures thereof. It may also comprise an expanded material, such as those described for the inner jacket layer 330. Typically the outer jacket will be foamed to a lesser degree than the inner jacket because less foaming generally results in a smoother finish that is more cosmetically appealing. The outer jacket may also comprise layers of expanded and non-expanded material that are coextruded.

Figure 4:
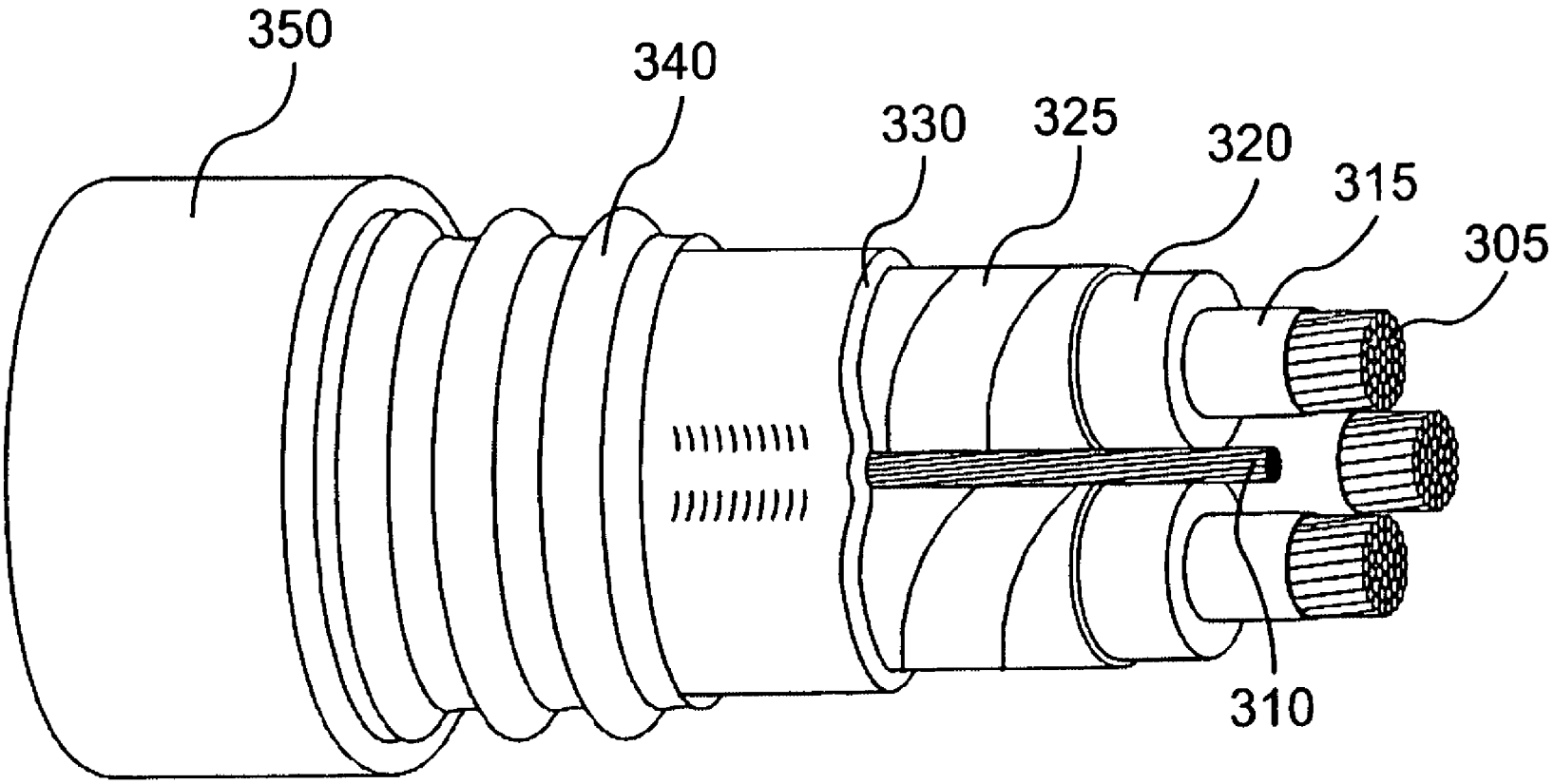
FIG. 4 is a longitudinal perspective diagram of the tripolar cable of FIG. 3A.

FIG. 4 is a longitudinal perspective view of the cable of FIG. 3A. It uses the same numbering as FIG. 3A to represent like parts.

Further measures are known to those skilled in the art who will be able to evaluate the most appropriate arrangement on the basis of, for example, the costs, the way the cable is to be laid (e.g., overhead, placed in ducts, buried directly below the ground, within buildings, below the sea, etc.), and the cable operating temperature (including the maximum and minimum temperatures, and temperature variations in the installation environment). For example, when producing a CSA type TECK90 cable, which is rated to −40° C., a leaded polymeric material such as PVC JG-513-GO produced by Poly One may be used as a jacketing material. Alternatively, a non-leaded material may be use, such as JGK-511-L produced by Poly One. Further modifications can be made depending on which standard or standards the cable is desired to meet (e.g., IEEE-1202, UL-1685, CSA Std. C22.2 FT-4, and/or IEC 332-3).

Figure 6:
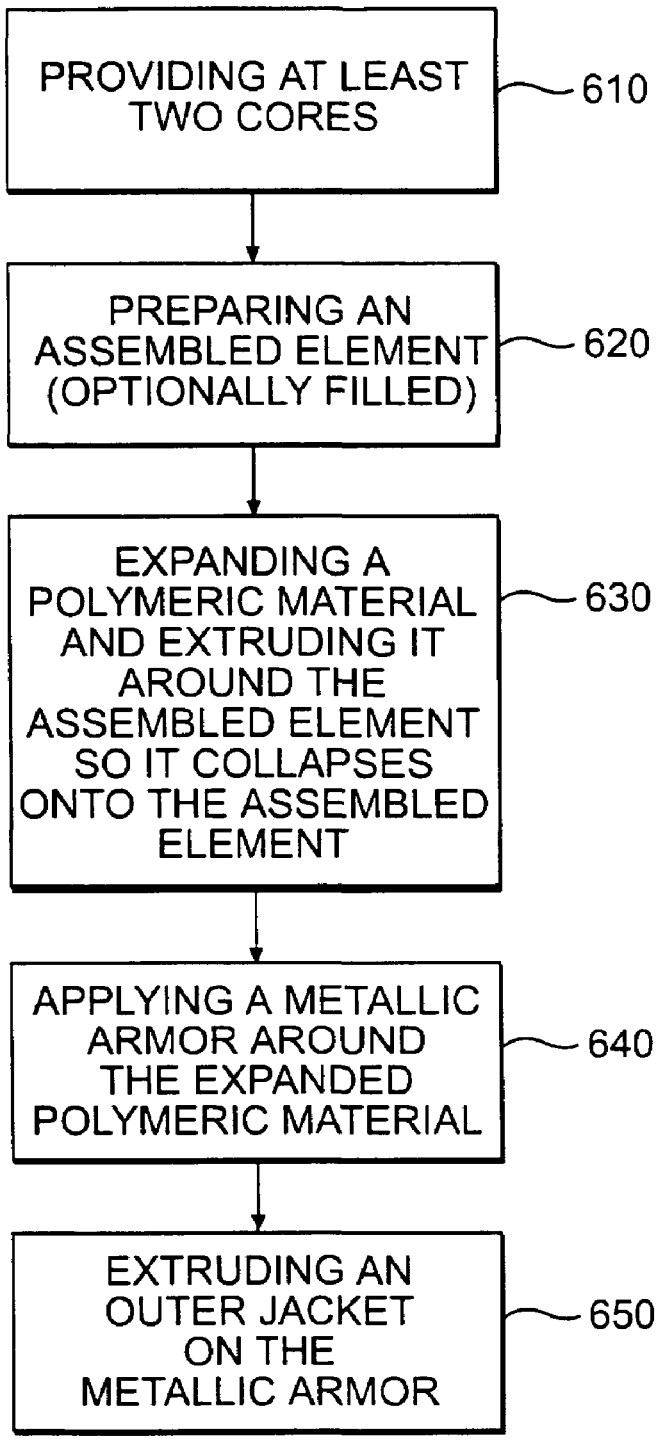
FIG. 6 is a process flow diagram of a method of manufacturing a cable consistent with the principles of the invention.

FIG. 6 is a high-level process flow diagram of a method of manufacturing a cable consistent with the principles of the invention. At least two cores are provided in a known manner (stage 610). Each core of the cable is obtained by unwinding a conductive element from a suitable feed spool and applying a layer of electrical insulation to it, generally by extrusion. At the end of the extrusion step, the material of the insulation layer is preferably cross-linked in accordance with known techniques, for example by using peroxides or silanes. Alternatively, the material of the insulation layer can be of the thermoplastic type that is not cross-linked, so as to ensure that the material is recyclable. Once completed, each core is stored on a first collection spool.

The assembled element, which in the embodiment of the cable shown in FIG. 3A comprises three separate cores and a ground wire, is then manufactured. The assembled element is obtained by using a cabling machine, which simultaneously winds and rotates the cores stored on separate collecting spools to twist them together helicoidally according to a predetermined pitch. Once obtained, the assembled element is stored on a second collection spool.

The optional filling layer may then be fibrous filler or applied by extrusion. In greater detail, the assembled element is unwound from the second collecting spool in accordance with any known technique, for example by using a pulling capstan designed to continuously and regularly provide the assembled element to an extrusion device (jacketing line). The pulling action should be constant over time so that the assembled element can move forward at a predetermined speed so as to ensure a uniform extrusion of the filler mentioned above.

The material for the inner jacket layer is expanded and extruded over the assembled element (stage 630). Each polymeric composition can incorporate a pre-mixing step of the polymeric base with other components (fillers, additives, or others), the pre-mixing step being performed in equipment upstream from the extrusion process (e.g., an internal mixer of the tangential rotor type (Banbury) or with interpenetrating rotors, or in a continuous mixer of the Ko-Kneader (Buss) type or of the type having two co-rotating or counter-rotating screws).

Each polymeric composition is generally delivered to the extruder in the form of granules and plasticized (i.e., converted into the molten state) through the input of heat (via the extruder barrel) and the mechanical action of a screw, which works the polymeric material and delivers it to the extruder crosshead where it is applied to the underlying core. The barrel is often divided into several sections, known as "zones," each of which has an independent temperature control. The zones farther from the extrusion die (i.e., the output end of the extruder) typically are set to a lower temperature than those that are closer to the extrusion die. Thus, as the material moves through the extruder it is subjected to gradually greater temperatures as it reaches the extrusion die. The expansion of the inner jacket (and optionally the filler material, if any is used) is performed during the extrusion operation using the products and parameters discussed above.

If a filler material is used, the assembled element is preferably delivered to extrusion equipment provided with a double-layer extrusion head, the equipment comprising two separate extruders flowing into a common extrusion head so as to respectively deposit the filling material and the inner jacket layer on the assembled element by coextrusion. The double-layer extrusion head comprises a male die, an intermediate die, and a female die. The dies are arranged in the sequence just discussed, concentrically overlapping each other and radially extending from the axis of the assembled element. The inner jacket layer 330 is extruded in a position radially external to the filling layer 335 through a conduit located between the intermediate die and the female die. Therefore, at the same time as the assembled element is unwound, the expandable polymeric composition used in the inner jacket layer 330 and the expanded or non-expanded polymeric composition used in the filler layer 335 are separately fed to the inlet of each extruder in a known way, for example by using two separate hoppers.

The semi-finished cable assembly thus obtained is generally subjected to a cooling cycle. The cooling is preferably achieved by moving the semi-finished cable assembly in a cooling trough containing a suitable fluid, typically well water/river water or closed loop cooling water system. The temperature of the water can be between 2° C. and 30° C., but preferably is maintained between 10° C. and 20° C. During extrusion and to some extent during cooling, the inner jacket layer 330 collapses to substantially take the shape of the periphery of the assembled element. Downstream from the cooling cycle, the assembly is generally subjected to drying, for example by means of air blowers, and is collected on a third collecting spool.

To obtain the cable illustrated in FIG. 3A, the production process further comprises a line where the semi-finished cable assembly is unwound from the third collecting spool, and a metal armor layer is applied in an known manner, such as by placing interlocking aluminum tape armor around the inner jacket (stage 640). The cable assembly is then fed to extrusion equipment designed to apply the outer jacket 350 (stage 650). If the outer jacket 350 is made from an expanded material, it may be expanded in the same manner as discussed for the inner jacket layer 330, although generally to a lesser degree than the inner jacket. Like the inner jacket layer 330, the outer jacket 350 is subjected to a suitable cooling step. The finished cable is wound onto a final collecting spool.

Those of ordinary skill in the art will recognize that several variations of this process can be used to obtain a cable consistent with the principles of the invention. For example, several stages of the process may be performed in parallel at the same time. These known variations are to be considered within the scope of the principles of the invention.

Cables were produced employing Polyvinyl Chloride Jacketing compound JG-513-GO produced by Poly One and foaming agent HOSTATRON SYSTEM PV 22167. Extrusion tooling was designed to provide a drawdown ratio ("DDR") of 1.5:1. Applicants have discovered that too high of a DDR negatively impacts the overall finish quality of the expanded jacket. For this jacketing compound a DDR of about 1.4:1 to about 1.9:1 has been found to be quite adequate, with a DDR of between about 1.6:1 and about 1.8:1 being preferable. A temperature profile was used as follows: 170° C. (Barrel Zone 1)/175° C. (Barrel Zone 2)/175° C. (Barrel Zone 3)/180° C. (Barrel Zone 4) /180° C. (Head)/180° C. (Die). The tip was adjusted flush with or slightly recessed from the die face. A slight vacuum was also applied to control the tightness of the jacket over the multi-conductor assembled element. Melt pressure ranged between 600 and 800 psi.

The test results of Table 2 were achieved as measured from the inner expandable jacket layer. The inner jacket was produced by the method described above using an addition rate of 0.2% HOSTATRON SYSTEM PV 22167 foaming masterbatch resulting in a density reduction of approximately 10%.

TABLE 2

| | Actual Test Values | CSA Spec'n C22.2 No. 131 Requirement |
|---|---|---|
| Tensile (MPa), minimum | 12.65 | 10.4 |
| Elongation (%), minimum | 239.00 | 100.0 |
| Aged tensile (% ret.), minimum | 108.00 | 75.0 |
| Aged elongation (% ret.), minimum | 75.00 | 65.0 |
| Oil-aged tensile (% ret.), minimum | 100.00 | 75.0 |
| Oil-aged elongation (% ret.), minimum | 95.00 | 75.0 |
| Deformation, maximum | 31.60 | 35.0 |

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

We claim:

1. A cable comprising:

at least two cores, the at least two cores being stranded together to form an assembled element;

an inner jacket layer comprising an expanded polymeric material surrounding and substantially taking the shape of the periphery of the assembled element, a cross-section of the inner jacket layer and assembled element being non-circular;

a metallic armor having a substantially circular cross-section surrounding and partially contacting the inner jacket layer; and a polymeric outer jacket surrounding the metallic armor and forming the exterior of the cable.

2. The cable of claim 1, wherein the cable has two cores and the cross-section of the assembled element and inner jacket layer is substantially oblong-shaped.

3. The cable of claim 1, wherein the cable has three cores and the cross-section of the assembled element and inner jacket layer is substantially triangular-shaped.

4. The cable of claim 1, wherein the cable has four cores and the cross-section of the assembled element and inner jacket layer is substantially diamond-shaped.

5. The cable of claim 1, wherein the inner jacket layer in a position bridging two stranded cores is concave in a direction toward the axis of the cable.

6. The cable of claim 1, further comprising inner interstices between the stranded cores on an axial side of the inner jacket layer.

7. The cable of claim 6, further comprising filler material within at least one of the inner interstices.

8. The cable of claim 7, wherein the filler material comprises fibrous or extruded material.

9. The cable of claim 1, further comprising outer interstices between the inner jacket layer and the metallic armor, the outer interstices being substantially devoid of filler material.

10. The cable of claim 9, wherein the number of outer interstices equals the number of cores in the cable.

11. The cable of claim 1, wherein the inner jacket layer is formed by extrusion with a drawdown ratio of about 1.4:1 to about 1.9:1.

12. The cable of claim 11, wherein the expanded polymeric material of the inner jacket layer is formed by extrusion with a drawdown ratio of about 1.6:1 to about 1.8:1 and has a degree of expansion in the range of about 30% to about 35%.

13. The cable of claim 1, wherein the expanded polymeric material of the inner jacket layer comprises at least one material selected from the group consisting of polyvinyl chlorides (PVC), ethylene vinyl acetates (EVA), low density polyethylene, linear low density polyethylene, medium density polyethylene, high density polyethylene, polypropylene, and chlorinated polyethylene.

14. The cable of claim 1, wherein the expanded polymeric material of the inner jacket layer has a degree of expansion in the range of about 2% to about 50%.

15. The cable of claim 14, wherein the expanded polymeric material of the inner jacket layer has a degree of expansion in the range of about 10% to about 12%.

16. The cable of claim 1, wherein the outer jacket polymer material comprises an expanded material.

* * * * *